US008247361B2

(12) United States Patent
Shimura et al.

(10) Patent No.: US 8,247,361 B2
(45) Date of Patent: Aug. 21, 2012

(54) FLUORINE-BASED LUBRICANT COMPOSITION

(75) Inventors: Akihiko Shimura, Ibaraki (JP); Ayumi Yamazaki, I, Ibaraki (JP); Wataru Sawaguchi, Ibaraki (JP); Masaki Tahara, Ibaraki (JP); Yoshihito Tani, Ibaraki (JP); Toshio Nitta, Ibaraki (JP)

(73) Assignee: NOK Kluber Co., Ltd., Tokyo (JP)

( * ) Notice: Subject to any disclaimer, the term of this patent is extended or adjusted under 35 U.S.C. 154(b) by 269 days.

(21) Appl. No.: 12/764,227

(22) Filed: Apr. 21, 2010

(65) Prior Publication Data

US 2010/0267597 A1 Oct. 21, 2010

(30) Foreign Application Priority Data

Apr. 21, 2009 (JP) ..... 2009-103042
Apr. 21, 2009 (JP) ..... 2009-103043

(51) Int. Cl.

| | |
|---|---|
| ***C07C 15/24*** | (2006.01) |
| ***C10M 169/00*** | (2006.01) |
| ***C10M 169/04*** | (2006.01) |
| ***C09G 3/00*** | (2006.01) |

(52) U.S. Cl. ..... 508/588; 508/182; 508/582; 508/590

(58) Field of Classification Search ..... 508/588, 508/590, 182, 582

See application file for complete search history.

(56) References Cited

U.S. PATENT DOCUMENTS 6,083,600 A 7/2000 Kasai et al.

FOREIGN PATENT DOCUMENTS

| | | |
|---|---|---|
| JP | 06-136379 | 5/1994 |
| JP | 2003-027079 | 1/2003 |
| JP | 2004-346318 | 12/2004 |
| JP | 2007-027079 | 2/2007 |
| JP | 2007-186609 | 7/2007 |
| JP | 2007-204547 | 8/2007 |
| WO | WO 99/51612 | 10/1999 |

*Primary Examiner* — Walter D Griffin
*Assistant Examiner* — Francis C Campanell
(74) *Attorney, Agent, or Firm* — Brinks Hofer Gilson & Lione

(57) ABSTRACT

A fluorine-based lubricant composition comprising a base oil and a fluorine-containing compound represented by the general formula:

$CF_3(CF_2)_n$ $O(CF_2O)_p(C_2F_4O)_q(C_3F_6O)_rRfCONHAr$ (wherein, Ar is a 2-benzimidazole group, Rf is a fluorocarbon group of carbon number of from 1 or 2, n is 0, 1 or 2, p, q and r are an integer satisfying the condition $p+q+r \leqq 100$, where one or two of p, q and r may be 0, and the $CF_2O$ group, the $CF_2O_4$ group and the $C_3F_6O$ group are the groups bound randomly in the main chain) as an additive containing in the base oil. The fluorine-based lubricant composition has an improved long term anti-rust property and thermal resistance property, and further the fluorine-based lubricant composition obtained by adding a thickening agent to the composition reduces abrasion of the sliding member such as electric contact having a noble metal surface including a gold or silver plating surface, a copper surface and a copper alloy surface.

10 Claims, No Drawings

FLUORINE-BASED LUBRICANT COMPOSITION

TECHNICAL FIELD

The present invention relates to a fluorine-based lubricant composition. More specifically, the present invention relates to a fluorine-based lubricant composition which is excellent in the long term anti-rust property and thermal resistant property or a fluorine-based lubricant composition which is effectively applied to a sliding members having a noble metal surface including a gold or silver plating surface, a copper surface or a copper-alloy surface.

BACKGROUND ART

A fluorine-based lubricant is widely used for the lubrication of various kinds of machineries such as automobiles, electric equipments, construction machines, information equipments, industrial machines, working machines, and the parts constituting these machineries. In recent years, in association with speeding-up, miniaturization, high qualification and weight saving, the temperature of these peripheral equipments is tended to increase more and more. In addition, there are requirements for anti-rust property at the time when equipments are used in coastal region or at the shipping for export, thus anti-rust characteristics, thermal resistance characteristics and the like are required.

Generally, for the improvement of the anti-rust property, it is proposed to add an additive having thermal resistance to the base oil to improve the performance of the lubricants. For example, in Patent Document 1, a lubricant oil composition comprising a fluorine-containing phosphorous compound is proposed. These lubricant oil compositions improve the abrasion resistance property, anti-rust property and the like without damaging the thermal resistance property. However, these compositions cannot comply with today's increasing requirement for thermal resistance property.

A lubricant oil (a grease) comprising a phosphate ester based compound having the perfluoropolyether group is proposed in Patent Document 2 and a lubricant oil (a grease) comprising an aryl phosphate compound and an aryl phosphonate compound with or without the mono- or poly-alkyleneoxide bonding group between phosphorus and fluorocarbon group is proposed in Patent Document 3. In these additives, since the fluorine-containing group and the phosphate group form C—O—P bond, hydrolysis is liable to occur and as a result thermal resistance and durability becomes poor. As the result, thermal resistance which is the original characteristics of fluorine oil/grease cannot be exerted.

In Patent Document 4, a lubricant used for the magnetic disc containing a stabilizing compound composed by the repeating units of $—(CF_2)_nO—$ and the terminal group $—CH_2NRR'$ is described. By using the obtained compound as the additive for perfluoropolyether, a good result can be obtained. However, improvement of the stability is further required.

In Patent Document 5, a lubricant whose stability is to be improved utilizing a compound having a pyridine ring is described. The compound having the pyridine ring contributes to the stability of the perfluoropolyether base oil and the obtained lubricant shows an excellent performance. However, for satisfying the increased recent level of the requirement for the anti-rust property, anti-gas property and anti-degradation property, further improvement is required.

In addition, as a lubricant for reducing the abrasion of a sliding member such as an electric contact having a noble metal surface including a gold plating surface or silver plating surface, a copper surface and a copper-alloy surface, a grease composition comprising at least one kind selected from the group consisting of organic zinc compounds and thiazole-based compounds and at least one kind selected from the group consisting of the titanate-based coupling agents and aluminum-based coupling agents is proposed. In addition, a grease composition comprising the quaternary ammonium salt of hectorite as the additive is also proposed (See Patent Documents 6 to 7).

However, the base oil used in these proposals is a synthetic hydrocarbon oil and the application for the fluorine-containing oil is not considered, thus they cannot comply with today's increasing requirement for lubricant in thermal resistance, etc.

As a lubricant containing fluorine-based lubricant which is known to be effective in the improvement of the ant-abrasive property and the like, there can be mentioned a lubricant comprising a phosphonic acid compound in which the perfluoropolyether group is the fluorine-containing group and a lubricant comprising a phosphate ester having the perfluoropolyether group. However, the efficacy of the anti-abrasive property of these lubricant is only confirmed for the steel material which is the mating material, and they are not effective against a noble metal surface, a copper surface and a copper-alloy surface (See Patent Documents 2 and 8)

PRIOR ART

[Patent Document]

[Patent Document 1] JP-A-2003-027079
[Patent Document 2] JP-A-6-136379
[Patent Document 3] Japanese Patent Publication 2002-510697 (Japanese translation of PCT international application)
[Patent Document 4] U.S. Pat. No. 6,083,600
[Patent Document 5] JP-A-2004-346318
[Patent Document 6] JP-A-2007-186609
[Patent Document 7] JP-A-2007-204547
[Patent Document 8] JP-A-2007-027079

DISCLOSURE OF INVENTION

Problems to be Solved by the Invention

The object of the invention is to provide a fluorine-based lubricant composition having improved long-term anti-rust property and thermal resistant property, excellent more than heretofore, without damaging the original performances of the fluorine oil or a fluorine-based lubricant composition effectively applied to a sliding member having a noble metal surface including a gold plating or silver plating surface, a copper surface or a copper-alloy surface.

Means to Solve the Problems

This object of the invention is attained by a fluorine based lubricant composition comprising a base oil and a fluorine-containing compound represented by the general formula:

$$CF_3(CF_2)_nO(CF_2O)_p(C_2F_4O)_q(C_3F_6O)_rRfCONHAr \quad [1]$$

(wherein, Ar is a 2-benzimidazole group, Rf is a fluorocarbon group of carbon number of 1 or 2, n is 0, 1 or 2, p, q and r are an integer satisfying the condition $p+q+r \leqq 100$, where one or two of p, q and r may be 0, and the $CF_2O$ group, the $C_2F_4O_4$ group and the $C_3F_6O$ group are the groups bound randomly in the main chain) as an additive containing in the base oil, or is attained by the above described fluorine-based lubricant composition in which thickening agent is further added together with the fluorine-containing compound.

Effect of the Invention

By adding a fluorine-containing compound having the 2-benzimidazole group in one end, the anti-rust property and thermal resistant property, and the like of the fluorine-based lubricant composition containing a fluorine-containing compound as the additive can be largely improved, without damaging low temperature characteristics, thermal resistance property, oxidation stability, temperature-viscosity characteristics, lubricating property, anti-abrasion property, anti-peeling property, low torque property, low noise property, initial affinity, anti-leaking/scattering property, anti-oozing property, shear property, anti-corrosion property, anti-sludge property, flowing property in a gas cavity, washing property, conductivity, low vapor pressure property, low dust generation property, low out-gas property, anti-fouling property, bio-degradation property, rubber-resistant property, resin-resistant property, weather-resistant property, water-resistant property, chemical-resistant property, high mechanical strength, adhesiveness, mold releasing property, non-adhesion property and durability at high temperature. Especially, as to the anti-rust property, it becomes possible to achieve a long-term anti-rust property.

The fluorine-containing compound used as the additive component of the fluorine-based lubricant composition has a nitrogen atom, and therefore has a non-conjugated electron pair in the molecular structure, and exerts proper coordination ability to the surface of the metal. In addition, since the compound has an amide bonding in the molecular structure, the compound has also a function to further stabilize the coordination ability with the metal surface. Due to these high coordination ability, absorption to the metal surface is strengthened, and thus the compound can exert anti-friction/abrasion property, thermal stability, anti-rust property, metal protection ability against a gas and the like.

Especially, the fluorine-based lubricant oil composition in which a thickening agent is added together with the fluorine-containing compound can exert excellent anti-friction/abrasion property to a noble metal surface such as a gold surface, a silver surface, a gold plating surface and a silver plating surface, a copper surface and a surface of a copper-alloy with a small amount of added elements, for example, Ag, Cd, Cr, Be, Be—Co or Te, Zn, Sn, Al, Ni, Si, Pb and the like.

EMBODIMENT OF CARRYING OUT THE INVENTION

As the fluorine-containing compound used as the additive of the fluorine-based lubricant oil, a fluorine containing compounds in which the one molecular end is the chemically inactive perfluoroalkyl group, and the other molecular end is modified by the 2-benzimidazole group which is a group of a heterocyclic compound containing a nitrogen atom, specifically represented by the general formula $$CF_3(CF_2)_nO(CF_2O)_p(C_2F_4O)_q(C_3F_6O)_rRfCONHAr \quad [I]$$

(wherein, Ar is a 2-benzimidazole group, Rf is a fluorocarbon group of carbon number of 1 or 2, n is 0, 1 or 2, p, q and r are an integer satisfying $p+q+r \leqq 100$, wherein distribution to some extent may be allowed for each integer and one or two of p, q and r may be 0, and the $CF_2O$ group, the $CF_2O_4$ group and the $C_3F_6O$ group are the groups bound randomly in the main chain) are used. These fluorine-containing compounds are used in the lubricant composition consisting of the base oil and the fluorine-containing compounds at approximately 0.1 to 99% by weight, preferably at approximately 0.5 to 50% by weight, more preferably at approximately 1 to 20% by weight. When it is used at a rate less than the above, a sufficient effect as the anti-rust agent and the lubricant cannot be obtained. On the other hand, when it is used at a rate more than the above, it cannot demonstrate efficiency corresponding cost performance, and furthermore, troubles such as the increase of the viscosity resistance and the like, resulting in the increase in the power consumption and torque may be occurred.

The fluorine-containing compound is manufactured by reacting fluorine containing polyether carboxylic acid fluoride represented by the general formula $$CF_3(CF_2)_nO(CF_2O)_p(C_2F_4O)_q(C_3F_6O)_xRfCOF \quad [II]$$

with 2-aminobenzimidazole.

Perfluoropolyether acid fluoride used for the manufacturing of the fluorine-containing compound can be easily obtained by the known method. Generally, by the oligomerization of hexafluoropropylene oxide in the presence of cesium fluoride catalyst and tetraglyme solvent, perfluoropolyether represented by the general formula [IV] is obtained.

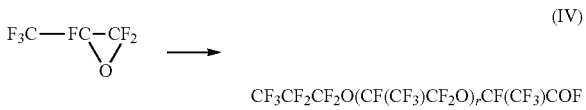

(IV)

From the viewpoint of the easiness of the preparation, the number average degree of polymerization (r) of hexafluoropropene oxide is preferably degree of $10 \leqq r \leqq 25$, and degree of r=15 is more preferable. In addition, the degree of polymerization may have a distribution of some extent. By the manufacturing method using the oligomer of hexafluoropropylene oxide, fluorine-containing polyether compound can be obtained most efficiently.

In addition, perfluoropolyether acid fluoride without a branched structure can be also obtained by the known method. As an example, perfluoroether acid fluoride represented by the general formula [V], obtained by the photo-oxidative polymerization of tetrafluoroethylene oxide, in which the tetrafluoroethylene oxide unit and the difluoromethoxy unit are bonded irregularly can be mentioned.

$$CF_3O(CF_2O)_p(CF_2CF_2O)_qCF_2COF \quad [V]$$

Here, as the other method of manufacturing perfluoropolyether acid fluoride without having a branched structure, there is also a method in which, after ring-open polymerization of tetrafluorooxetane by metal fluoride, the hydrocarbon methylene group of the part of repeating unit is fluorinated by the direct fluorination. However, it requires a long step.

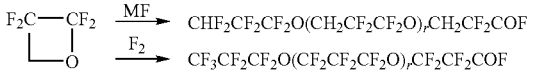

As shown in the above examples, the fluorocarbon group Rf is a perfluoroalkylene group or a branched perfluoroalkylene group of the carbon number of 1 to 2, and, for example, the —$CF_2$— group, the —$CF_2$ $CF_2^-$ group, and the —CF($CF_3$)— group are mentioned.

As 2-aminobenzimidazole used for the modification of perfluoropolyether carboxylic acid fluoride, (III)

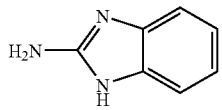

the commercial product can be used as it is in practice. 2-aminobenzimidazole can be substituted by at least one alkyl group, a halogen group and the like.

By reacting these fluorine-containing polyether compound and 2-aminobenzimidazole, while heating and stirring, the objective fluorine-containing compound can be obtained. In conducting the reaction, in order to capture HF produced by the reaction, it is preferable that the tertiary amine which is not contributed in the main reaction is presented at the same time. From the viewpoint of easiness of removal after reaction, preferably trialkylamine (the alkyl group has carbon number of 1 to 12, preferably 1 to 3), pyridines such as pyridine, dimethylaminopyridine are used, and from the viewpoint of easiness of handling, price and the like in addition to easiness of removal after reaction, triethylamine and pyridine are used more preferably.

In the reaction, it is possible to obtain the target product without using solvent particularly, however, in the case when stirring is difficult for the reason of the viscosity of perfluoropolyether and the like, it is also possible to decrease the viscosity by using organic solvent. As the organic solvent, taking into account the solubility of each reaction component, the fluorine-based organic solvent such as hydrochlorofluorocarbon, hydrofluorocarbon, hydrofluoroether are preferably used. In practice, commercial products such as AK-225 (product of Asahi Glass Co, Ltd.), NOVEC HFE (product of Sumitomo 3M Ltd.), and the like are used.

The reaction temperature is not particularly limited. However, after 2-amonobenzimidazole and HF capturing agent were dropped to the fluorine-containing polyether compound, it is preferably set at approximately 80 to 100° C., and more preferably at approximately 90 to 100° C. There is a case in which significant coloring occurs in the reaction mixture due to the oxidation of the amine compound at the time of reaction, and in order to avoid this phenomenon, it is preferable to increase the reaction temperature in a phased manner after the completion of dropping, specifically, for example, to increase the temperature at a rate of approximately 3 to 5° C. every 48 hours. In addition, since unnecessarily long reaction time may be a cause of coloring, the reaction is carried out for approximately 24 to 100 hours, preferably for approximately 48 to 72 hours.

After the reaction, the HF salt of amine and the like produced during the reaction is removed by the extraction treatment, however, in the case when the solvent was not used in the reaction, the fluorine-based organic solvent is used as the extraction solvent. As this fluorine-based organic solvent, the afore-mentioned commercial product is used as it. Here, as the extraction solvent to dissolve a water soluble material, water, brine, lower alcohol and the like are used and among these, from the viewpoint of the extraction ability of impurity and layer separation ability, methanol is preferably used.

As the fluorine oil used as the base oil in which the fluorine-containing compound is added as the additive having an anti-rust effect, perfluoropolyether oil is used generally. As the perfluoropolyether oil, the one represented by the general formula is used:

$$RfO(CF_2O)_x(C_2F_4O)_y(C_3F_6O)_zRf$$

wherein the groups $CF_2O$, $C_2F_4O$ and $C_3F_6O$ are those that bound to the main chain randomly. Specifically, for example, ones represented by the following general formulas (1) to (3) are used and the one represented by the general formula (4) is also used. Here, Rf is a lower perfluoroalkyl group of the carbon number of 1 to 5, preferably 1 to 3, such as the perfluoromethyl group, the perfluoroethyl group, the perfluoropropyl group and the like.

$$RfO[CF(CF_3)CF_2O]_zRf \quad (1)$$

Here, z=2 to 200. This compound is obtained by the complete fluorination of the precursor produced by the photo-oxidation of hexafluoropropylene or by treating the acid fluoride compound having the terminal $CF(CF_3)COF$ group obtained by the anionic polymerization of hexafluoropropylene in the presence of the cesium fluoride catalyst with a fluorine gas.

$$RfO(CF_2O)_x(CF_2CF_2O)_yRf \quad (2)$$

Here, x+y=3 to 200, and x:y=10 to 90:90 to 10. In addition, the $CF_2O$ group and the $CF_2CF_2O$ group are those that bound to the main chain randomly. This compound is obtained by the complete fluorination of the precursor produced by the photo-oxidation of tetrafluoroethylene.

$$RfO(CF_2O)_x[CF(CF_3)CF_2O]_zRf \quad (3)$$

Here, x+z=3 to 200, and x:z=10 to 90:90 to 10. In addition, the $CF_2O$ group and the $CF(CF_3)CF_2O$ group are those that bound to the main chain randomly. This compound is obtained by the complete fluorination of the precursor produced by the photo-oxidation of hexafluoropropene.

$$F(CF_2CF_2CF_2O)_{2\text{-}100}C_2F_5 \quad (4)$$

This compound is obtained by treating the fluorine-containing polyether $(CH_2CF_2CF_2O)_n$ obtained by the anion polymerization of 2,2,3,3-tetrafluorooxetane in the presence of fluorinated cesium catalyst with a fluorine gas at a temperature of approximately 160 to 300° C. under the condition of irradiation of ultraviolet ray.

These perfluoropolyether base oils can be used alone or in a mixture. In the case when used as the lubricant oil, its dynamic viscosity (40° C.) is approximately 5 to 2000 $mm^2$/sec., preferably approximately 10 to 1500 $mm^2$/sec. The evaporation amount of the base oil is large when the dynamic viscosity is less than these values, and in the case when it is used as the thermal resistant grease, it does not comply with the condition prescribed in JIS that the evaporation amount is equal to or less than 1.5% for three kinds of grease for the ball-and-roller bearing. On the other hand, when the dynamic viscosity of the base oil is more than these values, the flow point (according to JIS K-2269 corresponding to ASTM D5853) becomes 10° C. or higher, and bearing, gear, chain and the like are not driven at the time of low temperature by the usual method. Heating is required for making its use possible, and the oil becomes to lack eligibility as the grease of general purpose.

As the thickening agent to be added to the fluorine-based lubricant composition together with the fluorine-containing compound, powdery polytetrafluoroethylene [PTFE], tetrafluoroethylene-hexafluoropropene copolymer[FEP], a perfluoroalkylene resin and the like are used. As the polytetrafluoroethylene, polytetrafluoroethylene is used, which is manufactured by the polymerization method such as emulsion polymerization, suspension polymerization, solution polymerization, and the like, and then its number average molecular weight Mn is lowered between from approximately 1000 to 1000000 to approximately 100 to 500000, by the treatment such as thermal decomposition, decomposition by electron beam irradiation, physical pulvering and the like. Also, the copolymerizing reaction of tetrafluoroethylene and hexafluoropropene and the lowering of molecular weight of the copolymer are conducted the same as above, and the copolymer is used whose number average molecular weight Mn is lowered in approximately from 1000 to 600000. Molecular weight can be also controlled by using a chain-transfer agent at the time of co-polymerization. Among the obtained powdery fluororesin, those having the average primary particle size of 500 μm or less, preferably approximately 0.1 to 30 μm are used.

In addition, a thickening agent other than these powdery fluororesin can be also used, and as these thickening agents, the metal soap such as Li soap, a urea resin, minerals such as bentonite, organic pigments, polyethylene, polypropylene and polyamide can be also used. However, taking into account the thermal resistance and lubricity, metal salt of aliphatic dicarboxylic acid, metal salt of monoamide monocarboxylic acid, metal salt of monoestercarboxylic acid, diurea, triurea, tetraurea and the like are preferably used.

These thickening agents are used by adding at a rate of approximately 0.1 to 50% by weight, preferably approximately 10 to 40% by weight, based on the lubricant composition consisting of the base oil, the fluorine-containing compound and the thickening agent. When the thickening agent is used at the rate more than this value, the composition becomes too hard. On the other hand, when used at the rate less than this value, the thickening ability of the fluororesin and the like is not exerted, and as a result, oil separation becomes worse and the significant improvement of anti-scattering/leaking property cannot be expected.

In the fluorine-based lubricant composition, in addition to the above described components, it is possible to add, if necessary, the known additives such as pour point lowering agent, ashless-based dispersing agent, metal-based washing agent, antioxidant, other anti-rust agent, anti-corrosion agent, anti-foaming agent, anti-abrasive agent, oilness agent and the like, which are used in the lubricant in which the general synthetic oil is used as base oil, as necessary in a range whereby the object of the invention is not impaired. However, so as not to inhibit thermal resistance, low-temperature fluidity, and affinity to the bearing material of the final product, the amount of these additives are preferably to be requisite minimum.

As the pour point lowering agent, for example, di(tetraparaffin phenol)phthalate, a condensation product of tetraparaffin phenol, a condensation product of alkylnaphthalene, a condensation product of chlorinated paraffin and naphthalene, alkylated polystyrene and the like can be mentioned.

As the ashless-based dispersing agent, for example, succinimide, succinamide, benzyl amine, ester-based ashless dispersing agent and the like can be mentioned.

As the metal-based washing agent, for example, metal salt of sulfonic acid, typically dinonylnaphthalene sulfonic acid, metal salt of alkylphenol, metal salt of salicylic acid and the like can be mentioned.

As the antioxidants, for example, phenol-based antioxidants such as 2,6-ditertialybutyl-4-methylphenol, 4,4'-methylenebis(2,6-ditertialy-butylphenol) and the like, amine-based antioxidants such as alkyldiphenylamine (the carbon number of the alkyl group is 4 to 20), triphenyamine, phenyl-α-naphtylamine, phenothiazine, alkylated phenyl-α-naphtylamine, alkylated phenothiazine and the like, phosphorus-based antioxidants, sulfur-based antioxidants and the like can be mentioned. These antioxidants can be used alone or in a mixture of two kinds or more.

As the another anti-rust agent, for example, fatty acid, soap of fatty acid, alkylsulfonate, fatty acid amine, paraffin oxide, alkyl polyoxyethylene ether and the like can be mentioned.

As the anti-corrosion agent, for example, benzimidazole, benztriazole, thiadiazole and the like can be mentioned.

As the anti-foaming agent, for example, dimethylpolysiloxane, polyacrylic acid, metal soap, fatty acid ester, phosphate ester and the like can be mentioned.

As the anti-abrasive agent, for example, phosphorous-based compounds such as phosphate ester, phosphite ester, phosphate ester amine salt, and the like, sulfur-based compounds such as sulfides, disulfides and the like, chlorine-based compounds such as chlorinated paraffin, chlorinated diphenyl and the like and organic metal compound such as dialkyklithio phosphate zinc salt, dialkyldithiocarbamic acid molybdenum salt and the like can be mentioned.

As the oilness agent, for example, fatty acid or its ester, higher alcohol, polyhydric alcohol or its ester, fatty amine, fatty acid monoglyceride and the like can be mentioned.

The preparation of the lubricant oil composition is carried out by adding a determined amount of the fluorine-containing compound additive to the perfluoropolyether base oil and stirring the mixture. The obtained lubricant composition can be also used as a solution (a dispersion) diluted in the fluorine-based solvent such as hydrofluoroether, hydrofluorocarbon, perfluorocarbon and the like. This dispersion is subjected to use by vaporizing the fluorine-based solvent after applying to the sliding part.

EXAMPLES

The invention will be explained based on examples, however the invention is not limited to these examples.

Reference Example 1

In a flask equipped with a T-shaped connector for nitrogen sealing, a stirrer, a condenser, dropping funnel, a thermometer and a mantle heater for heating, 1020 g of perfluoropolyether carbonyl fluoride:

$$CF_3CF_2CF_2O[CF(OF_3)CF_9O]_rCF(CF_3)COF$$

(wherein r is 12, having a distribution to some extent) was charged and stirred. Then, a mixture of 51 g (372 mmol) of 2-aminobenzimidazole and 9 g of triethyl amine was dropped to the flask slowly at room temperature, and the temperature of the mantle heater was adjusted such that the inside temperature of the flask becomes 92±1° C. after completion of dropping, and further adjusted such that the inside temperature of the flask becomes 96±1° C. after 48 hours, and further heated and stirred for 24 hours. After confirming the signal of COF at 1885 $cm^{-1}$ was disappeared with IR spectrum, 250 mL of a fluorine-based organic solvent (AK-225 manufactured by Asahi Glass) was added to the reaction mixture and dissolved well by stirring, and then insoluble components such as hydrofluoric acid salt of amine and the like were removed using membrane filter. To the filtrate, 100 mL of above described fluorine-based organic solvent (AK-225) and 1200 g of methanol were added and mixed well, and extraction of the lower layer was carried out three times in a total. Finally, the fluorine-based organic solvent (AK-225) was removed under reduced pressure using an evaporator, and the below described fluorine-containing compound A was obtained (recovering amount: 1070 g).

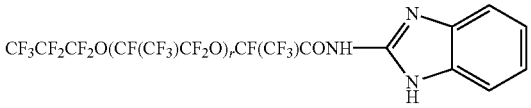

r:12 (the number average degree of polymerization of hexapropylene oxide obtained from F-NMR, having a distribution to some extent)

F-NMR (acetone-d6, $CFCl_3$)

−145.9 to −145.2 ppm; —$OCF(CF_3)CF_2O$—

−132.6 ppm; —$CF(CF_3)CONH$—

−131.0 ppm; $CF_3CF_2CF_2O$—

−86.1 to −74.9 ppm; —$OCF(CF_3)CF_2O$—, —$CF_3CF_2CF_2O$—

−84.1 ppm; —$CF_3CF_2CF_2O$—

−81.3 ppm: —$OCF(CF_3)CF_2O$—

−81.2 ppm; —$CF(CF_3)CONH$—

H-NMR (acetone-d6, TMS)

δ 7.20; ═N—C(C)—CH═CH—

δ 7.61; ═N—C(C)—CH═CH—

Reference Example 2

In the Reference Example 1, the reaction was conducted under heating and stirring, using 500 g of $CF_3CF_2CF_2O(CF_2CF_2CF_2O)_rCF_2CF_9COF$ (wherein r:20, having a distribution to some extent) as perfluoropolyether carbonyl fluoride, and in addition, by changing the amount of 2-aminobenzimidazole and triethyl amine to 18.8 g (137 mmol) and 3.3 g, respectively. After confirming the signal of COF at 1885 $cm^{-1}$ was disappeared with the IR spectrum, 100 mL of a fluorine-based organic solvent (AK-225) was added to the reaction mixture and dissolved well by stirring, and then insoluble components such as hydrofluoric acid salt of amine and the like were removed using membrane filter. To the filtrate, 100 mL of above described fluorine-based organic solvent (AK-225) and 600 g of methanol were added and well mixed, and extraction of the lower layer was carried out three times in a total. Finally, the fluorine-based organic solvent (AK-225) was removed under reduced pressure using an evaporator, and the below described fluorine-containing compound B was obtained (recovering amount: 482 g). The result of identification using NMR of this fluorine-containing compound was the same as that of Reference Example 1.

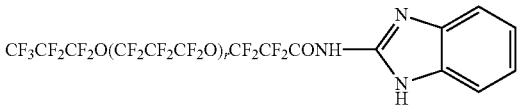

r:12 (having a distribution to some extent)

Reference Example 3

In the Reference Example 1, 35 g of 4-aminopyridine (372 mmol) was used in place of 2-aminobenzimidazole, and the inside temperatures of the flask after the completion of dropping and after 48 hours were changed to 90±1° C. and 95±1° C., respectively, and the below described fluorine-containing compound C was obtained (recovering amount: 998 g).

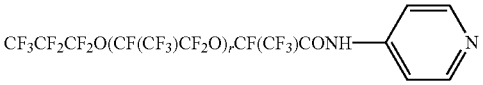

r:12 (having a distribution to some extent)

As the evaluation of thermal resistance, the half-weight temperature was determined for the fluorine-containing compounds A to C obtained in the Reference Examples 1 to 3, and for the below mentioned fluorine-containing compounds D to E.

[Fluorine Containing Compounds]

A: fluorine containing compound A obtained in the Reference Example 1

B: fluorine containing compound A obtained in the Reference Example 2

C: fluorine containing compound A obtained in the Reference Example 3

D: $C_3F_7O[CF(CF)CF_2O]CF(CF_3)$—CONH—$(CH)_6$—$NH_2$

E: $C_3F_7O[CF_2CF(CF_3)O]_{2\text{-}6}CF(CF_3)(CH_2)_2OPO(OC_2H_5)_2$

The evaluation of thermal resistance property was based on the determination of the half-weight temperature under the following conditions.

Test equipment: Thermogravimetry-Differential Thermal Analyzer(TG/DTA)

Starting temperature: 25° C.

Maximum temperature: 500° C.

Rate of temperature rise: 5° C./min

The results of measurement are shown in Table 1 below.

TABLE 1

| Additive | Half-weight temperature (° C.) |
|---|---|
| A | 292 |
| B | 308 |
| C | 303 |
| D | 380 |
| E | 226 |

Examples 1 to 11, Comparative Examples 1 to 6

The lubricant oil compositions were prepared by mixing the base oils below and afore-mentioned fluorine-containing compounds under stirring.

| [Base oil] | |
|---|---|
| A: $RfO[CF(CF_3)CF_2O]_sRf$ | Dynamic viscosity (40° C.) 100 $mm^2$/sec |
| B: $RfO[CF(CF_3)CF_2O]_sRf$ | Dynamic viscosity (40° C.) 400 $mm^2$/sec |
| C: $F(CF_2CF_2CF_2O)_tRf$ | Dynamic viscosity (40° C.) 100 $mm^2$/sec |
| D: $RfO(CF_2CF_2O)_u(CF_2O)_vRf$ | Dynamic viscosity (40° C.) 160 $mm^2$/sec |
| E: $RfO[CF(CF_3)CF_2O]_s(CF_2O)_vRf$ | Dynamic viscosity (40° C.) 230 $mm^2$/sec |

Wet test was conducted as the anti-rust test for the obtained lubricant oils. Anti-corrosion test (wet test)

Test method: ASTM D 1748

Temperature: 49±1° C.

Humidity: 95%

Time: 300 hours, 500 hours

Test piece: SPCC-SB of 60×80×1.2 mm

Evaluation method: The degree of the formation of rust after the testing was examined and evaluated according to the standard described below.

| Grade | Degree of formation of rust (%) |
|---|---|
| A | 0 |
| B | 1-10 |
| C | 11-25 |
| D | 26-50 |
| E | 51-100 |

The obtained results are shown in the following Table 2 together with kind of the base oil, and the additive and mixing ratio.

TABLE 2

| | Base oil | | F-containing compound | | Anti-rust test | |
|---|---|---|---|---|---|---|
| Example | Kind | Wt % | Kind | Wt % | 300 hours | 500 hours |
| Example 1 | A | 99.5 | A | 0.5 | A | A |
| Example 2 | A | 97.0 | A | 3.0 | A | A |
| Example 3 | A | 99.5 | B | 0.5 | A | A |
| Example 4 | A | 99.0 | B | 1.0 | A | A |
| Example 5 | A | 98.0 | B | 2.0 | A | A |
| Example 6 | A | 97.0 | B | 3.0 | A | A |
| Example 7 | B | 99.0 | B | 1.0 | A | A |
| Example 8 | E | 99.0 | B | 1.0 | A | A |
| Example 9 | C | 99.0 | B | 1.0 | A | A |
| Example 10 | E | 99.0 | B | 1.0 | A | A |
| Example 11 | D | 99.0 | B | 1.0 | A | A |
| Example 12 | A | 1.0 | B | 99.0 | A | A |
| Comp. Ex. 1 | A | 100.0 | | | D | D |
| Comp. Ex. 2 | C | 100.0 | | | D | D |
| Comp. Ex. 3 | D | 100.0 | | | D | D |
| Comp. Ex. 4 | A | 99.0 | D | 1.0 | B | B |
| Comp. Ex. 5 | A | 99.0 | C | 1.0 | A | B |
| Comp. Ex. 6 | A | 99.0 | E | 1.0 | A | A |

Examples 13 to 27, Comparative Examples 7 to 11

| [Base oil] | |
|---|---|
| F: $RfO(CF_2O)_x(CF_2CF_2O)_yRf$ | Dynamic viscosity (40° C.) 17 $mm^2$/sec |
| G: $RfO(CF_2O)_x(CF_2CF_2O)_yRf$ | Dynamic viscosity (40° C.) 33 $mm^2$/sec |
| H: $RfO(CF_2O)_x(CF_2CF_2O)_yRf$ | Dynamic viscosity (40° C.) 160 $mm^2$/sec |
| I: $RfO[CF(CF_3)CF_2O]_zRf$ | Dynamic viscosity (40° C.) 100 $mm^2$/sec |

[Thickening Agent]

A: Solution polymerization PTFE (m.p. 323° C., Average primary particle diameter 0.1 μm)

B: Emulsion polymerization PTFE (m.p. 327° C., Average primary particle diameter 0.1 μ)

C: Emulsion polymerization PTFE (m.p. 325° C., Average primary particle diameter 0.2 μm)

D: Suspension polymerization PTFE (m.p. 325° C., Average primary particle diameter 9 μm)

Greases were prepared by mixing the above described base oils and thickening agents with the predetermined amount (unit: Wt. %) of the fluorine-containing compounds obtained in afore-mentioned Reference Example 1.

The prepared greases were applied at the thickness of 0.25 mm on a silver plating plate, a copper alloy (C1100) plate, a gold plating plate and a stainless steel S45C plate, each plate having thickness of 2 mm. Each metal plate applied by the grease and a ball made of the same material as the metal used were set in the Trybo Gear surfaceness measurement equipment (product of Shinto Chemical), and the friction/abrasion test was conducted under following measurement conditions to determine the thickness of abrasion (unit:μm) of each plate after the test.

Loading weight: 80 gf

Test temperature: 80° C. or 140° C.

Sliding rate: 50 mm/sec.

Sliding distance (one way): 20 mm

Sliding frequency: 20,000 times

The obtained results are shown in the table below. In the table, the values of consistency (according to JIS K222.7 corresponding to ASTM D217) at room temperature of each grease used is shown simultaneously.

TABLE

| | Base oil | | PTFE | | F compound | Ag | Cu | Cu | Au | Fe | |
|---|---|---|---|---|---|---|---|---|---|---|---|
| Example | Kind | % | Kind | % | % | 80° C. | 80° C. | 140° C. | 80° C. | 80° C. | Consistency |
| Ex. 13 | G | 75.9 | B | 24 | 0.1 | 3.2 | | | | | 305 |
| Ex. 14 | G | 75.5 | B | 24 | 0.5 | 2.1 | | | | | 310 |
| Ex. 15 | G | 75 | B | 24 | 1 | 1.5 | | | | | 305 |
| Ex. 16 | F | 75.5 | A | 21.5 | 3 | 0.43 | | | | | 328 |
| Ex. 17 | F | 73 | B | 24 | 3 | 0.3 | 5.4 | | | | 313 |
| Ex. 18 | G | 73 | B | 24 | 3 | 0.3 | 4.3 | 3 | 0.3 | 0.3 | 305 |
| Ex. 19 | F | 67.5 | C | 29.5 | 3 | 0.4 | | | | | 301 |
| Ex. 20 | F | 61 | D | 36 | 3 | 0.53 | | | | | 333 |
| Ex. 21 | H | 73 | B | 24 | 3 | 0.3 | | | | | 283 |
| Ex. 22 | I | 73 | B | 24 | 3 | 0.3 | | | | | 279 |
| Ex. 23 | G | 71 | B | 24 | 5 | 0.3 | 4.3 | | | | 307 |
| Ex. 24 | G | 69 | B | 24 | 7 | 0.3 | 3.75 | | | | 301 |
| Ex. 25 | G | 66 | B | 24 | 10 | 0.3 | 2.8 | 0.9 | 0.3 | | 303 |
| Ex. 26 | G | 56 | B | 24 | 20 | 0.3 | | | | | 310 |
| Ex. 27 | G | 0.1 | B | 0.9 | 99 | 0.3 | 4.3 | | | | <viscous> |
| Comp. Ex. 7 | F | 78.5 | A | 21.5 | — | 7.05 | | | | | 343 |
| Comp. Ex. 8 | F | 76 | B | 24 | — | 8 | 6.5 | | | | 298 |
| Comp. Ex. 9 | G | 76 | B | 24 | — | 10 | 9.5 | 9.5 | 2.5 | 0.3 | 301 |

TABLE-continued

| Example | Base oil Kind | Base oil % | PTFE Kind | PTFE % | F compound % | Ag 80° C. | Cu 80° C. | Cu 140° C. | Au 80° C. | Fe 80° C. | Consistency |
|---|---|---|---|---|---|---|---|---|---|---|---|
| Comp. Ex. 10 | F | 70.5 | C | 29.5 | — | 6.17 | | | | | 298 |
| Comp. Ex. 11 | F | 64 | D | 36 | — | 8.17 | | | | | 328 |

From above described results, it could be concluded as follows:

(1) Excellent anti-abrasive property is shown in any of the silver plating plate, the copper alloy plate and the gold plating plate in each Example in which a specific fluorine-containing compound was added, however anti-abrasive property is not observed in the steel plate.

(2) Abrasion suppression effect is hardly observed in any of the silver plating plate, the copper alloy plate and the gold plating plate in each Comparative Example in which a specific fluorine containing compound is not added.

(3) In the combination of the base oil G and PTFE B, when the amount of the additive is changed variously, the abrasion depth of Ag begins to decrease rapidly at the addition of 0.1% by weight, and reaches to almost constant 0.3 μm at the addition of 3 to 99% by weight (Examples 13 to 15, 18, 23 to 27).

(4) When the base oil F is used and PTFE having various average primary particle diameter is used as the thickening agent, the abrasion depth of Ag shows a stable anti-abrasive property when the fluorine containing compound is added, however, when the fluorine containing compound is not added, a big abrasion occurs irrespective of the manufacturing method and particle size of PTFE (Examples 16 to 17, 19 to 20, Comparative Examples 7 to 8, 10 to 11)

(5) When the abrasion depth of Ag is measured for the base oil having various structures and dynamic viscosity, using PTFE B and the fluorine-containing compound additive at 3% by weight, almost constant value of 0.3 μm was obtained irrespective of the structure of the base oil and dynamic viscosity (Examples 17 to 18, 21 to 22).

(6) The depth of abrasion for each material in the case when the base oil G and PTFE B are used is compared between the case when the fluorine containing compound additive is used and the case when the fluorine containing compound additive is not used, a significant difference was observed for cases of the Ag plating plate, the copper alloy plate and the gold plating plate, however, almost no difference was observed for the case of the steel plate (Example 18 and Comparative Example 9).

[Industrial Applicability]

The fluorine-based lubricant composition of the present invention is used in the field where the lubricant is used, especially in the field where ant-rust property, gas-resistant property and degradation preventive property are required and in the field where the lubricant which can be used stably for a long time. Specifically, various kinds of machineries such as automobile auxiliary machinery, electric equipments, construction machines, information equipments, industrial machines, working machines, audio and visual equipments, precision/electrical•electronic equipment such as LBP, office machinery, recording medium such as PC, HDD, breaker, electric contact, semiconductor manufacturing device, home electric appliances, clean room, damper, metal processing, conveyance equipment, automobile industry OEM, railroad•ship•airplane industry, food. chug industry, steel, mining•glass•cement industry, chemical•rubber•resin industry, film tenter, paper industry, printing industry, wood industry, textile•apparel, machine parts in mutual movement, internal combustion, pump and the like and parts constituting these machineries are exemplified as subjects for which this lubricant is applicable.

More specifically, the fluorine-based lubricant composition is effectively used as lubricant oil or grease in the industry where barings such as ball-and-roller bearing, ball bearing, roller bearing, angular bearing, thrust bearing, impregnated bearing, iron-based bearing, copper-based bearing, hydrodynamic pressure bearing, resin bearing, inner ring rolling bearing, outer ring rolling bearing, and the like, linear motion device such as ball screw, direct acting bearing and the like, power transmission parts such as speed reduction machine•speed up machine, gear, chain, chain bush, motor and the like, oil•air pressure/bulb•tap/seal such as vacuum pump, bulb, seal for air pressure equipment and the like, working machine such as electric tool, fixation roller, spindle, torque limiter, engine, alternator, tension pulley, idler pulley, fuel pump, oil pump, inlet system•fuel, throttle, electronic controlled throttle, exhaust system parts (of exhaust circulation equipment and the like), cooling system, electric fan motor, fan coupling, water pump, air conditioning system, compressor, transport system, hub bearing, braking system, ABS, brake, steering system, power steering, suspension system, driving system, ball joint, transmission, inner•outer packaging (power window, head light, light axis adjustment of door mirror), fuel cell, linear guide, electric contact, AT switch, combination switch, power window switch and the like are used.

Especially, the fluorine-based lubricant composition in which fluorine containing compound and thickening agent are added is effectively used in equipments and parts in which various kind of switches such as throttle, electronic controlled throttle, trolley line, fuel cell, linear guide, electric contact for general home electric appliances, AT switch, combination switch, power window switch, brake switch, engine start switch and the like are used, especially preferably as the lubricant for the electric contact material in the field where the lubricant is used for the sliding member having a noble metal surface, a copper surface and a copper alloy surface.

The invention claimed is:

1. A fluorine-based lubricant composition comprising a base oil and a fluorine-containing compound represented by the general formula:

$$CF_3(CF_2)_nO(CF_2O)_p(C_2F_4O)_q(C_3F_6O)_rRfCONHAr \quad [I]$$

(wherein, Ar is a 2-benzimidazole group, Rf is a fluorocarbon group of carbon number of 1 or 2, n is 0, 1 or 2, p, q and r are an integer satisfying the condition $p+q+r \leqq 100$, wherein one or two of p, q and r may be 0, and the $CF_2O$ group, the $C_2F_4O_4$, group and the $C_3F_6O$ group are the groups bound randomly in the main chain) as an additive containing in the base oil.

2. The fluorine-based lubricant composition according to claim 1, wherein the base oil is perfluoropolyether oil.

3. The fluorine-based lubricant composition according to claim 1, wherein the fluorine-containing compound is contained at a rate of 0.1 to 99% by weight in the total amount of the base oil and the fluorine containing compound.

4. The fluorine-based lubricant composition according to claim 1, wherein the fluorine-containing compound is contained at a rate of 0.5 to 50% by weight in the total amount of the base oil and the fluorine-containing compound.

5. The fluorine-based lubricant composition according to claim 1, wherein the fluorine-containing compound is contained at a rate of 1 to 20% by weight in the total amount of the base oil and the fluorine-containing compound.

6. The fluorine-based lubricant composition according to claim 1, wherein a thickening agent is added together with the fluorine-containing compound.

7. The fluorine-based lubricant composition according to claim 6, wherein the thickening agent is contained at a rate of 0.1 to 50% by weight in the total amount of the base oil, the fluorine-containing compound and the thickening agent.

8. The fluorine-based lubricant composition according to claim 6, wherein the thickening agent is contained at a rate of 10 to 40% by weight in the total amount of the base oil, the fluorine-containing compound and the thickening agent.

9. A method of lubricating a sliding member having a noble metal surface, a copper surface, or a copper alloy surface comprising applying the lubricant composition of claim 6 to the sliding member.

10. A method of lubricating an electric contact point comprising applying the lubricant composition of claim 1 to an electric contact point.

* * * * *